US010267013B2

(12) United States Patent
Cieslar

(10) Patent No.: US 10,267,013 B2
(45) Date of Patent: Apr. 23, 2019

(54) CLOSURE, PARTICULARLY FOR CLOSING CONSTRUCTION AND TECHNOLOGICAL APERTURES

(71) Applicant: BERNDORF BADERBAU s.r.o., Bystřice nad Olší (CZ)

(72) Inventor: Rudolf Cieslar, Milíkov u Jablůnkova (CZ)

(73) Assignee: BERNDORF BADERBAU S.R.O., Olsi (CZ)

( * ) Notice: Subject to any disclaimer, the term of this patent is extended or adjusted under 35 U.S.C. 154(b) by 0 days.

(21) Appl. No.: 15/184,160

(22) Filed: Jun. 16, 2016

(65) Prior Publication Data

US 2016/0369473 A1 Dec. 22, 2016

(30) Foreign Application Priority Data

Jun. 18, 2015 (CZ) ..... 2015-408
Jun. 18, 2015 (CZ) ..... 2015-31222

(51) Int. Cl.

| | |
|---|---|
| ***E02D 29/14*** | (2006.01) |
| ***E05B 65/00*** | (2006.01) |
| ***E05C 3/00*** | (2006.01) |
| ***E05B 35/00*** | (2006.01) |
| ***E05C 3/12*** | (2006.01) |
| ***E05B 15/00*** | (2006.01) |
| ***E05C 3/14*** | (2006.01) |

(52) U.S. Cl.

CPC ..... *E02D 29/1427* (2013.01); *E05B 15/0093* (2013.01); *E05B 35/008* (2013.01); *E05B 65/006* (2013.01); *E05C 3/006* (2013.01); *E05C 3/12* (2013.01); *E05C 3/14* (2013.01)

(58) Field of Classification Search

CPC ... E02D 29/1427; E05B 65/006; E05C 3/006; E05C 3/14

See application file for complete search history.

(56) References Cited

U.S. PATENT DOCUMENTS

| | | | | |
|---|---|---|---|---|
| 3,530,696 | A * | 9/1970 | Dunmire | E05B 65/006 404/25 |
| 4,739,896 | A * | 4/1988 | Moss | E02D 29/1427 220/324 |
| 6,811,119 | B1 * | 11/2004 | Petersen | E02D 29/1427 244/114 R |
| 9,803,396 | B2 * | 10/2017 | Timothy | E05C 3/06 |
| 2013/0074415 | A1 * | 3/2013 | Rix | E05B 35/008 49/465 |

(Continued)

*Primary Examiner* — Kristina R Fulton
*Assistant Examiner* — Thomas L Neubauer
(74) *Attorney, Agent, or Firm* — Ladas & Parry LLP

(57) ABSTRACT

A closure, particularly for closing construction and technological apertures, the principle of which consists in that on the bottom side of the cover of the closing hole a rocker arm is pivotally mounted, the functional part of which in the closed position of the cover rests on the opposite element, which is anchored in the closing hole. The rocker arm is pivotally attached on a pin that is anchored by means of brackets to the bottom part of the cover. The axis of the pin, on which the rocker arm is mounted, may be either parallel to the longitudinal axis of the closing hole or perpendicular to it. The rocker arm and the rocker lug are balanced relative to the pin so that the closure is maintained in a closed position.

13 Claims, 4 Drawing Sheets

(56) References Cited

U.S. PATENT DOCUMENTS

2013/0093196 A1* 4/2013 Beer ..... E05C 3/008
292/130
2013/0180990 A1* 7/2013 Procunier ..... B65D 51/243
220/284

* cited by examiner

CLOSURE, PARTICULARLY FOR CLOSING CONSTRUCTION AND TECHNOLOGICAL APERTURES

TECHNICAL FIELD

The invention relates to a closure intended for closing or covering all construction and technological apertures, for the use in dry areas, but especially in areas under water, i.e. for example in septic tanks and pools.

STATE OF THE ART

For closing covers of construction and technological apertures, usually the principle of a bolt and screw in the flange of an opposite plate or a bayonet key principle of a bayonet lock on the opposite plate are used.

The technical problem consists in the fact that bolted joints, or bolts, are very often in a wet environment or in an environment that is flooded. It follows that subsequent handling during unscrewing, or re-screwing with a screwdriver, a wrench or Allen wrench is very time-consuming and often uncomfortable for the operator when working underwater. At the same time, a considerable problem arises from the surface oxidation of bolted joints, which often leads to bolt breakage, and the consequent lengthy repair. Simultaneously, the same problem is connected with the fit of openings in the cover into the axis of the threads in the opposite plate. It is therefore very hard to ensure the alignment of the screws with threads. It sometimes happens that due to the misalignment of the screw against the thread, the threads are destroyed and thus unusable for further anchoring.

SUMMARY OF THE INVENTION

The object of the present invention is to alleviate the disadvantages of the above problems. This object is met by the present invention for closing construction and technological holes on a different principle, which is characterized in that on the bottom side of the cover of the closing hole a rocker rocker arm is pivotally mounted, the functional part of which in the closed position of the cover rests on the opposite element, which is anchored in the closing hole. The rocker arm is pivotally attached on a pin that is anchored by means of brackets to the bottom part of the cover. The axis of the pin, on which the rocker arm is mounted, may be either parallel to the longitudinal axis of the closing opening or perpendicular to it. The rocker arm and the rocker lug are balanced relative to the pin so that the closure is maintained in a closed position.

The rocker arm itself is provided with an arm which in the open position abuts on the bottom wall of the cover, as well as with a lug, the functional part of which abuts is in the closed position of the cover on the opposite element. A spring can be connected to the lug for locking the lug in the closed position. The functional part of the lug of the rocker arm is inclined, so as to provide a self-locking connection with the opposite element in the closed position of the closure.

The closure according to the invention allows an easy, quick and repeatable closing of any technology apertures and its advantages are particularly apparent by apertures in areas under water, i.e. for example in septic tanks and pools. In these cases, the closing of apertures for example by means of a screw is very uncomfortable and not only during repeated opening and closing a thread damage may occur.

The closure according to the invention can reliably close the opening, which may be formed in horizontal or vertical walls of the technological objects.

BRIEF DESCRIPTION OF THE DRAWINGS

An exemplary embodiment of the closure according to the invention is illustrated in the accompanying drawings, wherein the FIG. 1 shows a schematic solution of the mechanism of the closure, wherein the axis of the pivot of the rocker arm is perpendicular to the axis of the closing opening, the FIG. 2 shows the closed opening from above with the mechanism showed in the FIG. 1, the FIG. 3 shows a schematic solution an alternative embodiment of the closure mechanism, wherein the axis of the pivot of the rocker is parallel to the axis of the closing opening and allows even the mounting on a vertical wall, and the FIG. 4 shows a separate rocker arm with a lug.

EXAMPLE OF AN EMBODIMENT ACCORDING TO THE INVENTION

Figure 1:
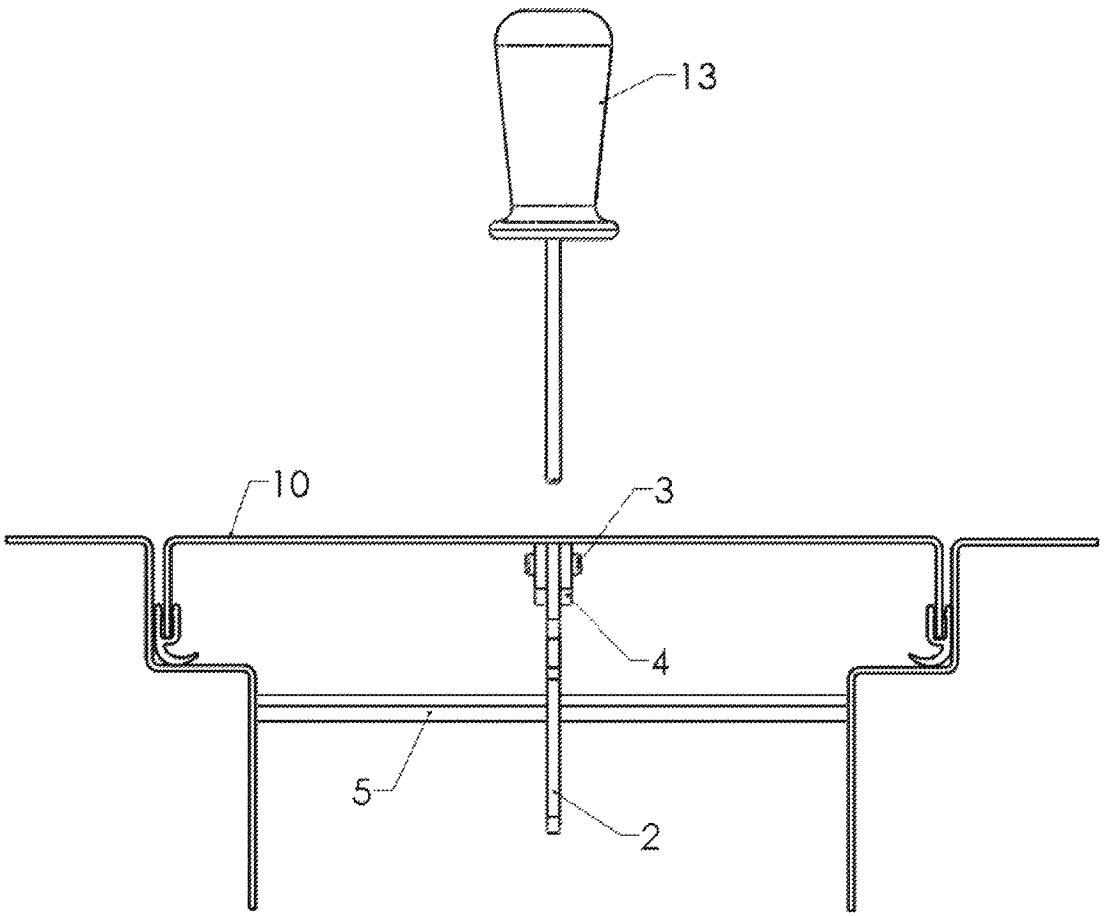
Figure 2:
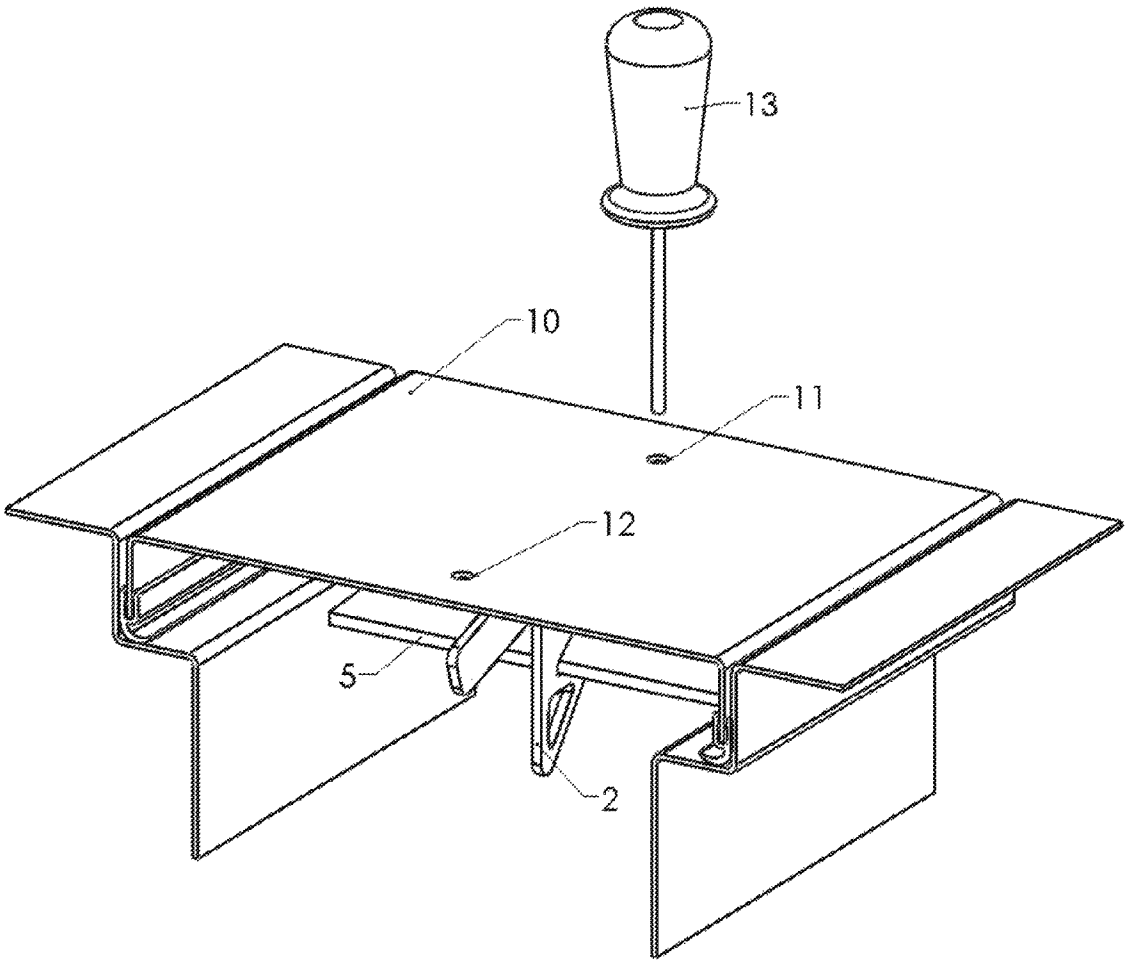
Figure 3:
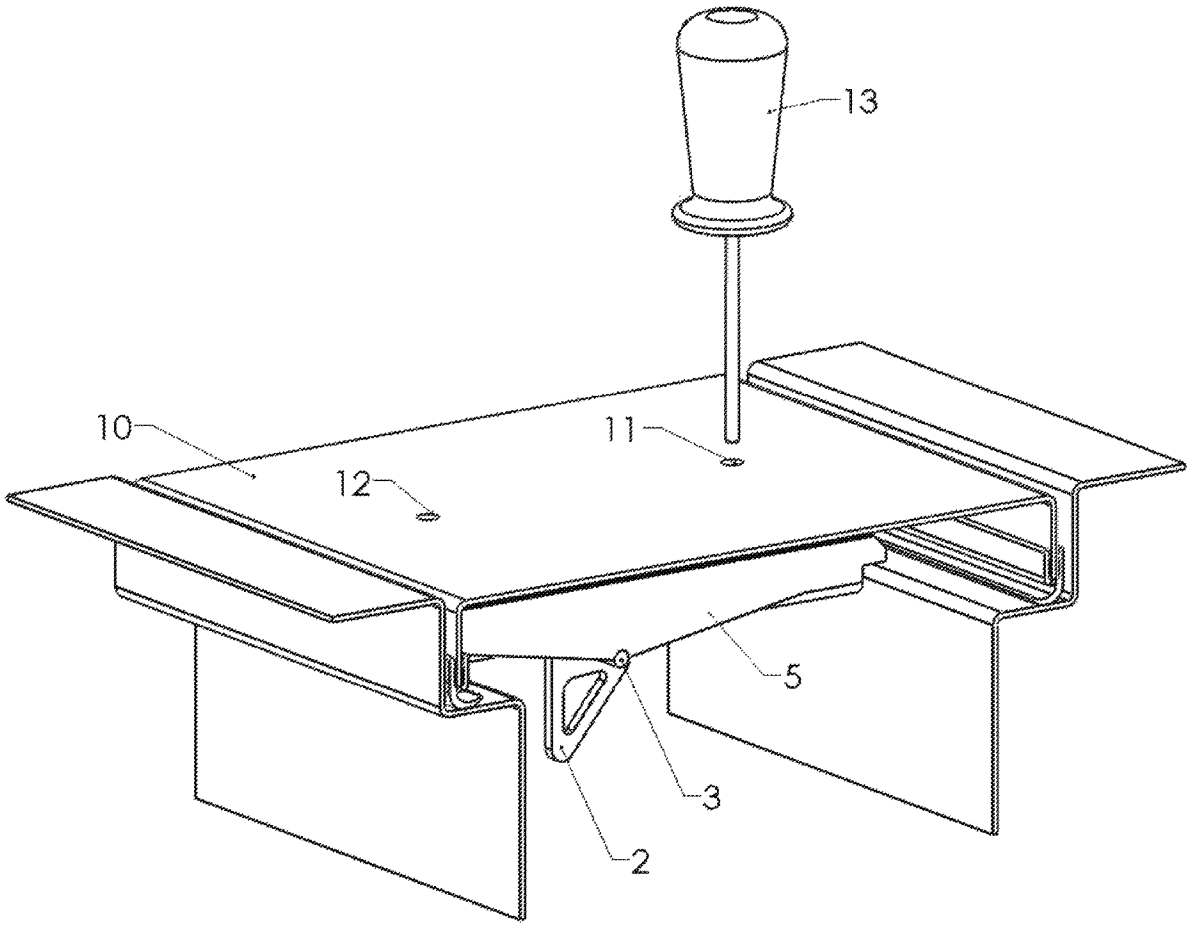
Figure 4:
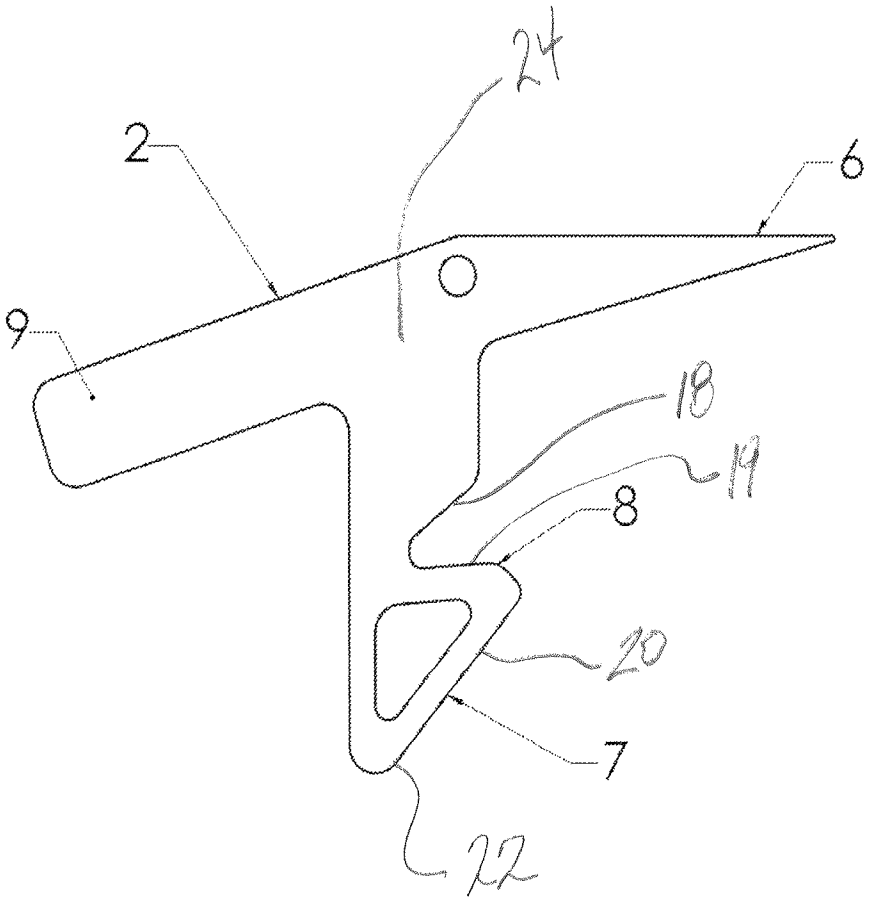

The invention of the closure is based on the function of a rocker arm 2, which is provided with an opening through which a pin 3, which is firmly anchored by means of brackets 4 of the pin 3 on the bottom wall of the cover of the closing hole. The closing hole may be both in a horizontal and in a vertical plane or also in a plane inclined, and any such solution is the part of this utility model. The brackets 4 are on the bottom side of the cover fastened usually permanently, mainly by welding, or detachably, thus, for example by means of a bolt and a nut. It is advantageous if the pin 3 and the brackets 4 of the pin are separated from the rocker arm 2 by an insulating layer. The actual rocker arm 2 and the two brackets 4 of the pin are made of precisely cut thick sheet of required shape.

The rocker arm 2 is provided with an arm 6, a lever or arm 9, and an arm 16 which intersect at a three-way junction 24. The lever or arm 9 in the open position of the closure rests on the bottom wall of the cover 10. Arm 16 has a lug 7 at end 22 thereof. The lug comprises a notch 8 which in the closed position of the cover 10 engages the opposite element 5. The notch 8 is structurally made so as to slide in the prescribed position under the opposite element 5 and to create together a solid closure. The opposite element 5 may be provided on the bottom part appropriately even with a rotable touch 14 to facilitate a relative movement between these parts of the mechanism.

The arm 6 of the rocker arm 2 and the lug 7 of the rocker arm 2 are relative to the pin 3 balanced so that the closure is maintained in a closed position. A spring can be connected to the lug 7 for locking the lug 7 in the closed position. The sloped surface 20 of the lug 7 of the rocker arm 2 is inclined, so as to provide a self-locking connection with a opposite element 5 in the closed position of the closure.

A cover 10 of the blocking aperture 1 is provided with a closing hole 12, which by means of a key 13 allows closing the closure, and with an opening hole 11, which allows its opening. The opening hole 11 is positioned above arm 6 of the rocker arm 2 and the closing hole 12 is located above the lever 9 of the rocker arm 2.

The notch 8 is formed by inclined surfaces 19 and 20. The lug 7 of the arm 16 is provided with sloped surface 20 at end 22, which while pushing the cover 10 onto the technological opening, allows to be deflected into the closed position of the lug 7 without using a cylindrical thrust key 13. The cylindrical thrust key 13 thus being applied only in the case of the complete closure of the lug 7 of the rocker arm 2 under the opposite element 5 or in the case of its reopening.

As far as the shape and weight are concerned, the rocker arm 2 is made so as to have the center of gravity on the side of the lever 9 of the rocker arm 2. The rocker arm 2 is thus pushed by means of the gravity force into the closed position. To rotate the rocker arm 2 to the open position is thus necessary to overcome the gravitation force of the gravity center of the rocker arm 2. The gravity center of the rocker arm 2 is made so that the gravitation forces act on the rocker arm both in the vertical position and in the horizontal position. This feature enables to lock horizontal floor and vertical wall covers of construction as well as technological openings. The gravitation force can be strengthened by a spring force or equivalent technical means.

Applying a force through the cylindrical thrust key 13, which may be, however, formed in another shape as well, inserted into the opening hole 11, the key acts on the arm 6 of the rocker arm 2, and the rocker arm 2 is rotated about the axis of the pin 3 so that the lug 7 slips out from the opposite element 5, and the whole mechanism will thus get into the open position.

Through the force of the cylindrical thrust key 13 on the lever 9 of the rocker arm 2, the lug 7 of the rocker arm 2 slides under the opposite element 5 of the technological opening, thus creating a fixed connection between the cover 10 and this opening. At the time of closing the rocker arm 2, the lever 9 of the rocker arm 2 touches from below the cover 10 of the closing aperture 1. The closing hole 12 may be used to facilitate closing the opening, and the opening hole 11 serves to release the entire mechanism to the open position. For closing and opening the entire mechanism, just a simple cylindrical thrust without a technologically modified contact interface is sufficient.

INDUSTRIAL APPLICATION

This invention is suitable for closing or covering all construction and technological apertures, and can be used in dry areas, but especially in areas under water, i.e. for example in septic tanks and pools.

LIST OF REFERENCE NUMERALS

1—aperture
2—rocker arm
3—pin
4—bracket
5—opposed element
6—arm
7—lug
8—notch
9—lever or arm
10—cover
11—opening hole
12—closing hole
13—key
14—touch
16—arm
18—inclined surface
19—inclined surface
20—sloped surface
22—end of third arm
24—3 way junction

The invention claimed is:

1. An apparatus for closing an opening defined by walls to which an opposing element is anchored, the apparatus comprising:

a cover comprising a top surface, a bottom surface and opposing first and second ends;

a rocker;

means for pivotally mounting the rocker on the cover;

the rocker comprising a first arm projecting from the rocker in a direction toward the first end of the cover with the rocker pivotally mounted on the cover, a second arm projecting from the rocker in a direction toward the second end of the cover with the rocker pivotally mounted on the cover, and a third arm projecting from the rocker in a direction away from the cover with the rocker pivotally mounted on the cover, the first arm having a top surface that is inclined relative to a top surface of the second arm, the respective top surfaces of the first and second arms intersecting at an angle exterior to the rocker of greater than 180°, the rocker comprising a pivot aperture adjacent the intersection around which the rocker is pivotable between a first position and a second position with the top surface of the first arm being adjacent to the cover with the rocker pivotally mounted on the cover in the first position and with the top surface of the second arm being adjacent to the cover with the rocker pivotally mounted on the cover in the second position, the third arm comprising a notch with inclined surfaces for engaging the opposing element to hold the cover in place over the opening when the rocker is in the first position and for disengaging from the opposing element when the rocker is moved from the first position to the second position, the first, second and third arms intersecting at a common, 3-way junction, the notch in the third arm being spaced from the common junction and being between the common junction and an end of the third arm, the cover comprising means for permitting a tool to pass through the top and bottom surfaces of the cover to move the rocker either from the first position to the second position or from the second position to the first position.

2. The apparatus according to claim 1, wherein each of the top and bottom surfaces of the cover are planar.

3. The apparatus according to claim 1, wherein the means for permitting comprises a plurality of holes in the cover, including a first hole for inserting the tool to move the rocker from the first position to the second position and a second hole for inserting the tool to move the rocker from the second position to the first position.

4. The apparatus according to claim 1, wherein the rocker has a center of gravity closer to the first arm than the second arm whereby the rocker is biased toward the first position in response to gravitational forces.

5. The apparatus according to claim 1, further comprising the opposing element.

6. The apparatus according to claim 1, further comprising the tool.

7. The apparatus according to claim 1, wherein the rocker is of unitary construction.

8. The apparatus according to claim 4, wherein the end of the third arm comprises a sloped surface that causes the third arm to be deflected past the opposing element and into the first position when the cover is pushed onto the opening and gravity biases the rocker toward the first position.

9. The apparatus according to claim 8, wherein the inclined surfaces of the notch comprise first and second surfaces that are inclined at an acute angle to one another with the second surface being disposed further away from the pivot aperture than the first surface, and wherein the sloped surface at the end of the third arm is adjacent to the second surface of the notch and is inclined at an acute angle with respect to the second surface such that, when the cover is pushed onto the opening and gravity biases the rocker toward the first position, the sloped surface at the end of the third arm slides past the opposing element to force the opposing element into the notch.

10. A rocker for use in securing a cover to an elongate element anchored between two walls with a planar surface of the cover covering an opening between the walls, the rocker being of unitary construction and comprising a first arm projecting from the rocker in a first direction, a second arm projecting from the rocker in a second direction away from the first direction, and a third arm projecting from the rocker in a third direction away from the first and second arms, the first arm having a top surface that is inclined relative to a top surface of the second arm, the respective top surfaces of the first and second arms intersecting at an angle exterior to the rocker of greater than 180°, the rocker comprising a pivot aperture adjacent the intersection around which the rocker is pivotable between a first position wherein, with the rocker pivotally mounted on the cover through the pivot aperture, the first arm is adjacent a first portion of the planar surface of the cover, and a second position wherein, with the rocker pivotally mounted on the cover through the pivot aperture, the second arm is adjacent a second portion of the planar surface of the cover, the third arm comprising a notch with inclined surfaces for engaging the elongate element to hold the cover in place over the opening when the rocker is pivotally mounted on the cover in the first position and for disengaging from the opposing element when the rocker is pivotally mounted on the cover and biased from the first position to the second position, the first, second and third arms intersecting at a common, 3-way junction, the notch in the third arm being spaced from the common junction and being between the common junction and an end of the third arm.

11. The rocker according to claim 10, wherein the rocker has a center of gravity closer to the first arm to the second arm whereby the rocker is biased toward the first position in response to gravitational forces.

12. The rocker according to claim 11, wherein the end of the third arm comprises a sloped surface that causes the third arm to be deflected past the opposing element and into the first position when the cover is pushed onto the opening and gravity biases the rocker toward the first position.

13. The rocker according to claim 12, wherein the inclined surfaces of the notch comprise first and second surfaces that are inclined at an acute angle to one another with the second surface being disposed further away from the pivot aperture than the first surface, and wherein the sloped surface at the end of the third arm is adjacent to the second surface of the notch and is inclined at an acute angle with respect to the second surface such that, when the cover is pushed onto the opening and gravity biases the rocker toward the first position, the sloped surface at the end of the third arm slides past the opposing element to force the opposing element into the notch.

* * * * *